US010023374B2

(12) United States Patent
Ou

(10) Patent No.: US 10,023,374 B2
(45) Date of Patent: Jul. 17, 2018

(54) ANTI-THEFT DISPLAY CARD

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 15/371,447

(22) Filed: Dec. 7, 2016

(65) Prior Publication Data

US 2018/0155103 A1 Jun. 7, 2018

(51) Int. Cl.

| | |
|---|---|
| ***B65D 73/02*** | (2006.01) |
| ***E05B 73/00*** | (2006.01) |
| ***B25H 3/00*** | (2006.01) |
| ***B65D 73/00*** | (2006.01) |
| ***B65D 79/00*** | (2006.01) |

(52) U.S. Cl.

CPC ..... *B65D 73/02* (2013.01); *B25H 3/003* (2013.01); *B65D 73/0064* (2013.01); *B65D 79/00* (2013.01); *E05B 73/00* (2013.01)

(58) Field of Classification Search

CPC ..... A47F 7/00; B25H 3/003; B65D 73/0064; B65D 73/02; B65D 79/00; E05B 73/00

USPC ..... 206/376–378; 211/70.6

See application file for complete search history.

(56) References Cited

U.S. PATENT DOCUMENTS 5,740,911 A * 4/1998 Chou ..... B65D 73/0064 206/1.5
6,070,745 A * 6/2000 Dembicks ..... B25H 3/06 206/378
7,124,900 B2 * 10/2006 Hu ..... B65D 73/0064 211/70.6
8,448,787 B1 * 5/2013 Chang ..... B65D 73/0064 206/378
8,864,097 B2 * 10/2014 Wang ..... F16M 13/005 206/378

FOREIGN PATENT DOCUMENTS

TW M504682 7/2015

* cited by examiner

*Primary Examiner* — Bryon Gehman
(74) *Attorney, Agent, or Firm* — Muncy, Geissler, Olds & Lowe, P.C.

(57) ABSTRACT

An anti-theft display card is provided, including: a main body, having at least one sleeved structure protruding thereon, the at least one sleeved structure having a through slot open on a free end thereof and forming two restricting walls spacingly, a side of the main body opposite to the through slot having at least one through hole communicating with the through slot, a direction in which the two restricting walls face each other defining a variation direction; at least one restricting member, each said restricting member having a connecting portion connected to the main body and at least one abutting portion, each said abutting portion being inserted into one said through slot of the at least one sleeved structure through one of the through holes to restrict the two restricting walls to move relative to each other along the variation direction.

10 Claims, 5 Drawing Sheets

ANTI-THEFT DISPLAY CARD

BACKGROUND OF THE INVENTION

Field of the Invention

The present invention relates to a display card, and more particularly to an anti-theft display card.

Description of the Prior Art

An anti-theft display card is used to show a replaceable connector for a wrench, as disclosed in TWM504682, when showing, an elastic sleeved structure is inserted into an assembling slot of the replaceable connector, an abutting portion which has a restricting member is disposed through the sleeved structure so that the sleeved structure cannot retract inward, and the replaceable connector is fixed on the anti-theft display card. When a user needs to take down the replaceable connector, s/he has to cut off the restricting member and take out the abutting portion first.

However, the conventional abutting portion is sheet-shaped, the abutting portion which is sheet-shaped has weaker ability to resist twisting, and the sleeved structure has enough space for the abutting portion to twist therewithin so that the abutting portion cannot abut against the sleeved structure and loses the anti-theft effect. In addition, the abutting portion which is sheet-shaped has weaker strength and shorter service life, and the replaceable connector may fall off easily during a delivery process.

The present invention has arisen to mitigate and/or obviate the afore-described disadvantages.

SUMMARY OF THE INVENTION

The major object of the present invention is to provide an anti-theft display card which has preferable anti-theft effect and service life, and it is easy and convenient to assemble and manufacture the anti-theft display card.

To achieve the above and other objects, an anti-theft display card is provided, including: a main body, having at least one sleeved structure which is protrudingly disposed thereon, the at least one sleeved structure having a through slot open on a free end thereof and forming two restricting walls spacingly, a side of the main body opposite to the through slot of the at least one sleeved structure having a through hole which communicates with the through slot of the at least one sleeved structure, a direction in which the two restricting walls face each other defining a variation direction; at least one restricting member, each said restricting member having a connecting portion which is connected to the main body and at least one abutting portion, each said abutting portion being inserted into one said through slot of the at least one sleeved structure through one of the through holes to restrict the two restricting walls to move relative to each other along the variation direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
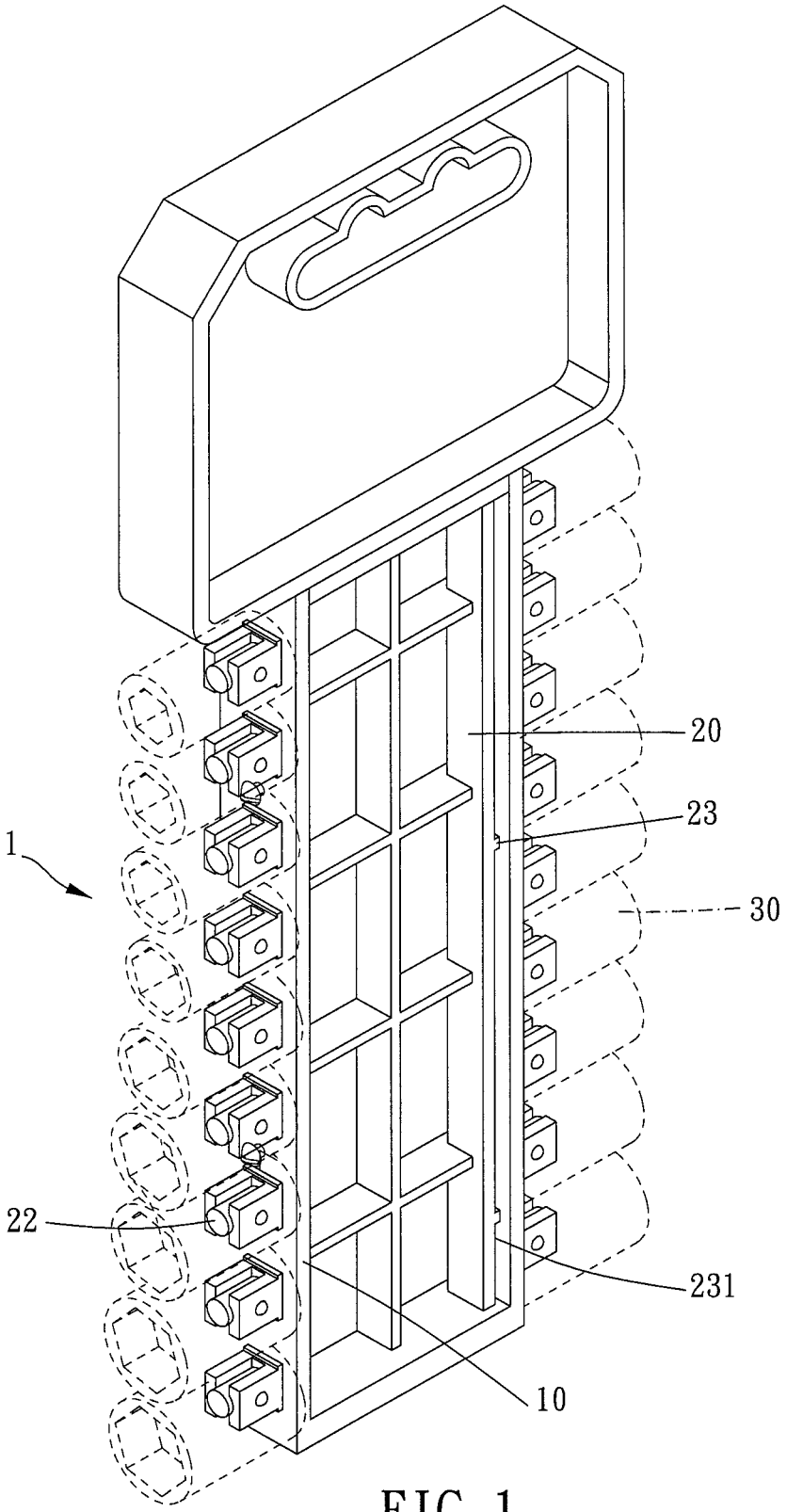
FIG. 1 is a stereogram of a preferred embodiment of the present invention.
Figure 2A:
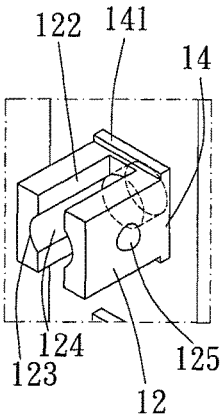
FIG. 2A is a partially-enlarged view of FIG. 2.
Figure 2:
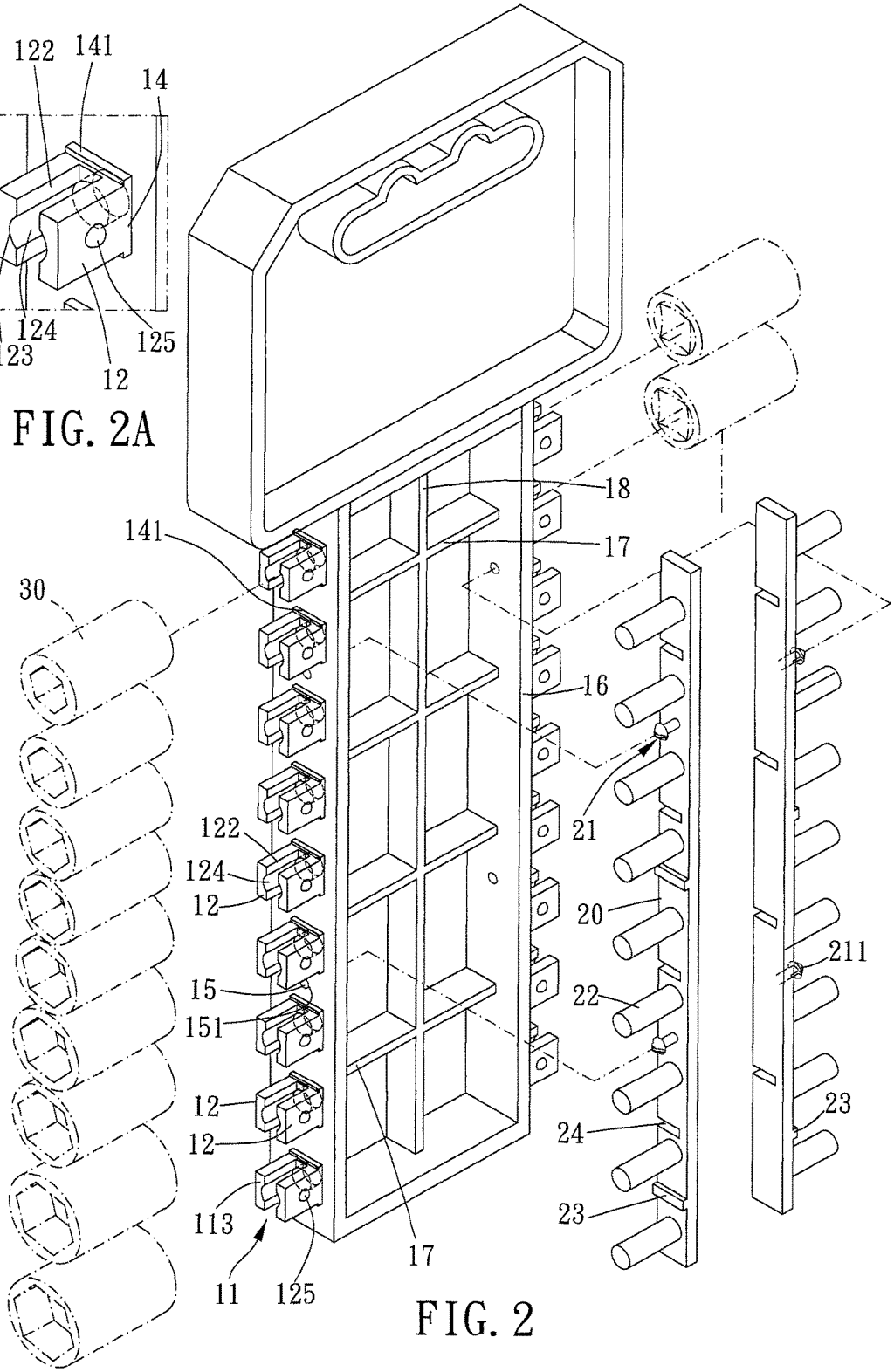
FIG. 2 is a breakdown view of the preferred embodiment of the present invention.
Figure 3:
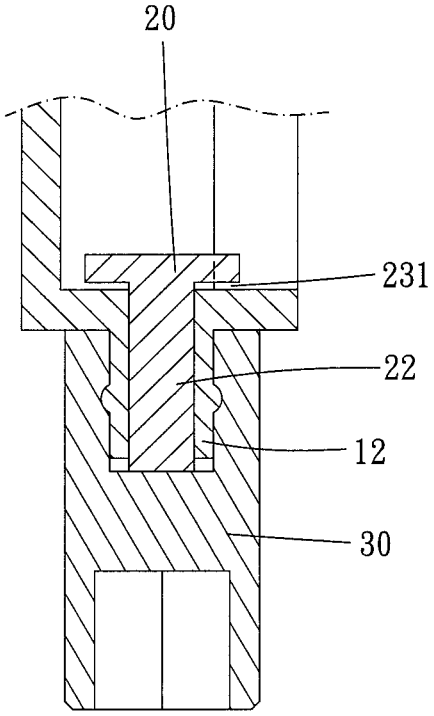
FIG. 3 is a cross-sectional enlarged view of the preferred embodiment of the present invention.
Figure 3A:
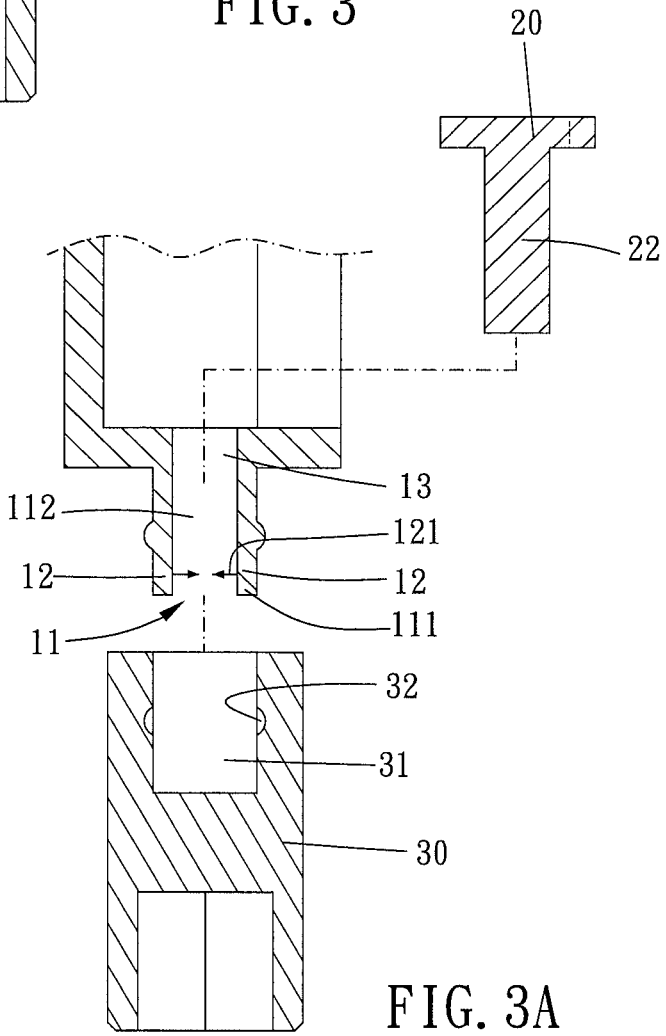
FIG. 3A is a breakdown view of FIG. 3.
Figure 4:
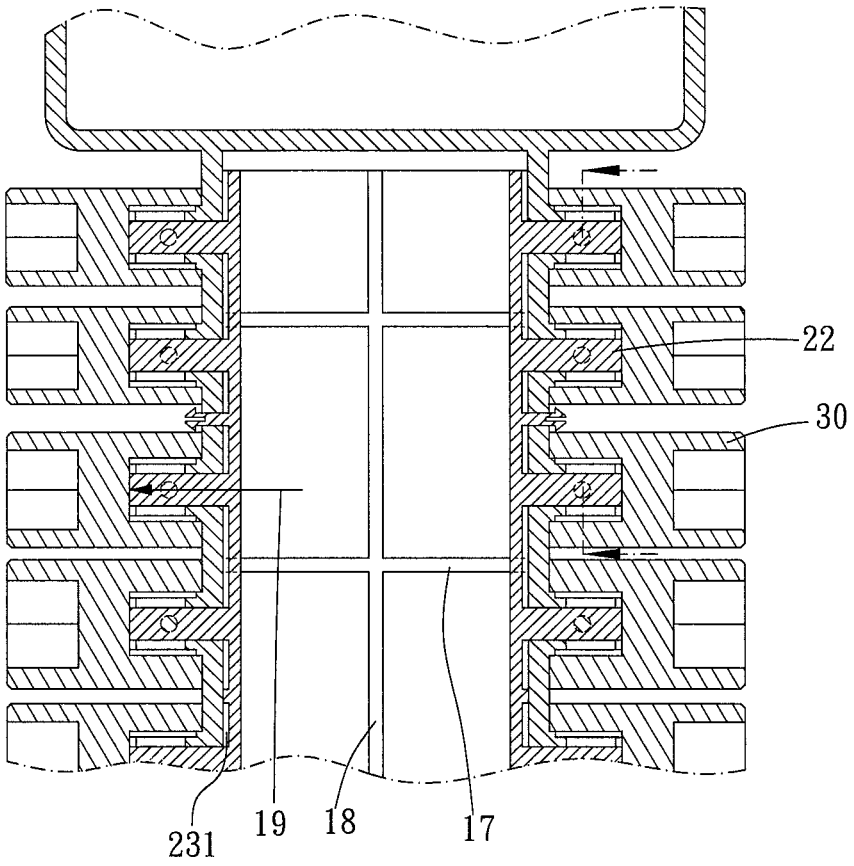
FIG. 4 is another cross-sectional enlarged view of the preferred embodiment of the present invention.
Figure 4A:
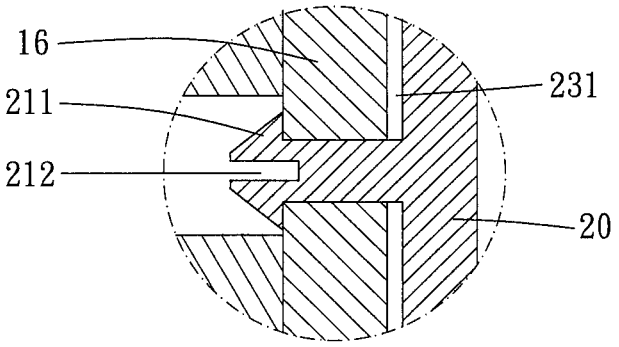
FIG. 4A is a partially-enlarged view of FIG. 4.
Figure 5:
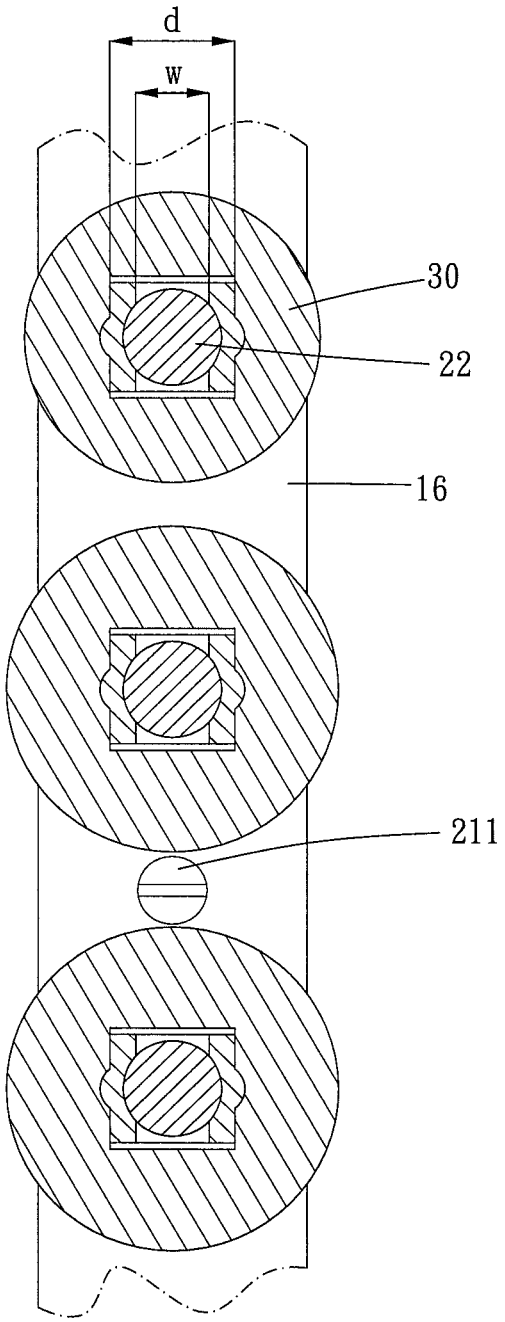
FIG. 5 is another cross-sectional view of the preferred embodiment of the present invention.

Please refer to FIGS. 1 to 5 for a preferred embodiment of the present invention. An anti-theft display card 1 includes a main body 10 and at least one restricting member 20.

The main body 10 has at least one sleeved structure 11 which is protrudingly disposed thereon, the at least one sleeved structure 11 has a through slot 112 open on a free end 111 thereof and forms two restricting walls 12 spacingly, a side of the main body 10 opposite to the through slot 112 of the at least one sleeved structure 11 has a through hole 13 which communicates with the through slot 112 of the at least one sleeved structure 11, and a direction in which the two restricting walls 12 face each other define a variation direction 121. Each of the at least one restricting member 20 has a connecting portion 21 which is connected to the main body 10 and at least one abutting portion 22, each said abutting portion 22 is inserted into one said through slots 112 of the at least one sleeved structure 11 through one of the through holes 13 to restrict the two restricting walls 12 to move relative to each other along the variation direction 121. Thereby, a tool 30 can be fixed on the sleeved structure 11 until the restricting member 20 is taken off.

In this embodiment, the through slot 112 is continuously open on two opposite sides of the free end 111 and a free end face 113. Inner faces 122 of the two restricting walls 12 facing each other each have an abutting groove 123, and each said abutting groove 123 has an abutting face 124 which is complementary to a circumferential face profile of the abutting portion 22. Preferably, the abutting portion 22 is a cylinder, a diameter d of the cylinder is greater than a width w of the through slot 112, and each said abutting face 124 is an arc face which extends from the through hole 13 to the free end face 113. The abutting portion 22 which is cylindrical has equal strengths on a radial direction and cannot be twisted easily so that the abutting portion 22 has a preferable abutting effect and a longer service life. The abutting groove 123 has a positioning effect, and the abutting face 124 is complementary to the abutting portion 22 so that the abutting portion 22 is inserted into the through slot 112 more easily and has greater contact area to prevent stress concentration. Preferably, the abutting portion 22 protrudes beyond the free end 111 so as to prevent the two restricting walls 12 from retracting inward on the variation direction 121 because of protruding beyond the abutting portion 22 and prevent the tool 30 from falling off.

Each said sleeved structure 11 includes a bottom portion 14 having the through hole 13, the two restricting walls 12 extend from a place which is distant from an outer periphery 141 of the bottom portion 14 in a distance, and the outer periphery 141 of the bottom portion 14 protrude beyond the two restricting walls 12 respectively perpendicular to the variation direction 121. The bottom portion 14 is engaged with the sleeve hole 31 of the tool 30, the outer periphery 141 respectively protrude beyond the two restricting walls 12 on the variation direction 121, and the sleeved structure 11 has a fixed width the same as that of the bottom portion 14 along the variation direction 121 so that the sleeved structure 11 is slightly smaller than the sleeve hole 31 and can be inserted into the sleeve hole 31 more easily.

The main body 10 further has at least one restricting hole 15, the connecting portion 21 of each said restricting member 20 includes at least one restricting head 211, and the at least one restricting head 211 is elastically deformable and disposed through the at least one restricting hole 15 and blocks a part of at least one restricting hole periphery 151 of the main body 10. This embodiment includes four said restricting holes 15 and two said restricting members 20, each said restricting member 20 includes two said restricting heads 211, the four restricting holes 15 are round holes, the four restricting heads 211 are cones which respectively have a recess 212 at a tip thereof and are made of an elastic material so that the four restricting heads 211 can be forced to retract inward and disposed through the four restricting holes 15, and each of the four restricting holes 15 is smaller than a bottom face of the cone in diameter; therefore, after the four restricting heads 211 are disposed through the four restricting holes 15, the four restricting heads 211 block the main body 10 and are unretractable. A user needs to break the connecting portion 21 first and remove the restricting member 20 before taking off the tool 30.

At least one of the two restricting walls 12 includes a protrusion on a face by a side opposite to the through slot 112, and the protrusion 125 is for being engaged with a restricting recess 32 in a sleeve hole 31 of a tool 30. In this embodiment, the two restricting walls 12 both have the protrusion 125, the protrusion 125 is curved and can be engaged with the restricting recess 32 easily, when the abutting portion 22 is located between the two restricting walls 12, a moving range of the two restricting walls 12 on the variation direction 121 is smaller than a height of the protrusion 125 on the variation direction 121 so as to blockably restrict the tool 30.

The main body 10 further includes at least one side board 16 which is lateral to the at least one sleeved structure 11, the at least one side board 16 has the at least one sleeved structure 11, each said side board 16 has at least one said through holes 13 and at least one restricting hole 15, the two side boards 16 are arranged parallel to each other, and each of the side board 16 has a part of the plurality of sleeved structures 11 opposite to each other. In this embodiment, the main body 10 includes two said side boards 16 which is strip-shaped and two said restricting members 20, the two side boards 16 has nine said sleeved structures 11 along a longitudinal direction, a number of the sleeved structures and a number of the tools 30 to be display are the same, the sleeved structures 11 of the two side boards 16 are arranged toward outside, and the four restricting heads 211 are disposed through the four restricting holes 15 from a place between the two side boards 16 toward outside. Specifically, each said restricting member 20 further includes at least one spacing protrusion 23, and the at least one spacing protrusion 23 and the two restricting heads 211 abut respectively against two opposite sides of one of the at least one side board 16. In this embodiment, each said restricting member 20 has two said spacing protrusions 23, and two said restricting heads 211 and two said spacing protrusions 23 can split force and prevent the restricting member 20 from rotating. Through the two spacing protrusions 23, a space 231 is formed between the restricting member 20 and the side board 16 so that a hand tool can be projected therein to break the connecting portion 21.

The main body 10 further includes at least one rib portion 17, and each said restricting member 20 has at least one receiving groove 24 into which the at least one rib portion 17 is inserted. In this embodiment, the main body 10 includes four said rib portions 17, the four rib portions 17 are laterally connected between the two side boards 16, each said restricting member 20 has four said receiving grooves 24, a random number of the rib portions 17 can be arranged on the main body 10 according to various requirements so as to prevent the main body 10 from being damaged because of a weight of the tool 30 or during delivery, and the four receiving grooves 24 have positioning functions so that it is convenient to assemble the restricting member 20. The main body 10 further include a spacing rib 18 which is laterally connected to the four rib portions 17, a distance between each said side board 16 and the spacing rib 18 is greater than a dimension of the restricting member 20 along a referential direction 19, and the referential direction 19 passes through the abutting portion 22 and is parallel to a longitudinal direction of the abutting portion 22. Therefore, after the user breaks the connecting portion 21 and retracts the restricting member 20 until abutting against the spacing rib 18, the abutting portion 22 is completely detached from the sleeved structure 11 so as to take off the restricting member 20 directly.

Given the above, the abutting portion is disposed through the sleeved structure and preferably protrudes beyond the sleeved structure, and the rib portion and the spacing rib help to reinforce strength to achieve a preferable abutting effect. Therefore, the anti-theft display card has a longer service life and stronger strength and is easier to be manufactures.

While we have shown and described various embodiments in accordance with the present invention, it should be clear to those skilled in the art that further embodiments may be made without departing from the scope of the present invention.

What is claimed is:

1. An anti-theft display card, including:

a main body, having at least one sleeved structure which is protrudingly disposed thereon, the at least one sleeved structure having a through slot open on a free end thereof and forming two restricting walls which are spaced apart from each other, a side of the main body opposite to the through slot of the at least one sleeved structure having at least one through hole communicated with the through slot of the at least one sleeved structure, a direction in which the two restricting walls face each other defining a variation direction;

at least one restricting member, each said restricting member having a connecting portion which is connected to the main body and at least one abutting portion, each said abutting portion being inserted into one said through slot of the at least one sleeved structure through one of the through holes to restrict the two restricting walls to move relative to each other along the variation direction;

wherein the main body further has at least one restricting hole, the connecting a portion of each said restricting member includes at least one restricting head, and the at least one restricting head is elastically deformable and disposed through the at least one restricting hole and blocks a part of at least one restricting hole periphery of the main body.

2. The anti-theft display card of claim 1, wherein each said sleeved structure includes a bottom portion having one said through hole, the two restricting walls extend from the bottom portion, and an outer periphery of the bottom portion protrude beyond the two restricting walls respectively perpendicular to the variation direction.

3. The anti-theft display card of claim 1, wherein inner faces of the two restricting walls facing each other each have an abutting groove, and each said abutting groove has an abutting face which is complementary to a circumferential face profile of the abutting portion.

4. The anti-theft display card of claim 3, wherein the abutting portion is a cylinder, and each said abutting face is an arc face.

5. The anti-theft display card of claim 1, wherein the abutting portion protrudes beyond the free end.

6. The anti-theft display card of claim 1, wherein at least one of the two restricting walls includes a protrusion on a face by a side opposite to the through slot, and the protrusion is for being engaged with a restricting recess in a sleeve hole of a tool.

7. An anti-theft display card, including:

a main body, having at least one sleeved structure which is protrudingly disposed thereon, the at least one sleeved structure having a through slot open on a free end thereof and forming two restricting walls which are spaced apart from each other, a side of the main body opposite to the through slot of the at least one sleeved structure having at least one through hole communicated with the through slot of the at least one sleeved structure, a direction in which the two restricting walls face each other defining a variation direction; at least one restricting member, each said restricting member having a connecting portion which is connected to the main body and at least one abutting portion, each said abutting portion being inserted into one said through slot of the at least one sleeved structure through one of the through holes to restrict the two restricting walls to move relative to each other along the variation direction;

wherein the main body further includes at least one side board which is lateral to the at least one sleeved structure, the at least one side board has the at least one sleeved structure, each said side board has at least one said through hole and at least one restricting hole, the connecting portion of each said restricting member includes at least one restricting head, and the at least one restricting head is elastically deformable and disposed through the at least one restricting hole and blocks a part of at least one restricting hole periphery of the main body.

8. The anti-theft display card of claim 7, wherein the main body further includes at least one rib portion, and each said restricting member has at least one receiving groove into which the at least one rib portion is inserted.

9. The anti-theft display card of claim 8, wherein each said restricting member further includes at least one spacing protrusion, and the at least one spacing protrusion and the at least one restricting head abut respectively against two opposite sides of one of the at least one side board.

10. The anti-theft display card of claim 9, wherein the through slot is continuously open on two opposite sides of the free end and a free end face; each said sleeved structure includes a bottom portion having the through hole, and the two restricting walls extend from a place which is distant from an outer periphery of the bottom portion in a distance; the outer periphery of the bottom portion protrude beyond the two restricting walls respectively perpendicular to the variation direction; inner faces of the two restricting walls facing each other each have an abutting groove, and each said abutting groove has an abutting face which is complementary to a circumferential face profile of the abutting portion; the abutting portion is a cylinder, each said abutting face is an arc face, and a diameter of the cylinder is greater than a width of the through slot; the abutting portion protrudes beyond the free end; the main body further has at least one restricting hole, the connecting portion includes at least one restricting head, and the at least one restricting head is elastically deformable and disposed through the at least one restricting hole and blocks a part of at least one restricting hole periphery of the main body; at least one of the two restricting walls includes a protrusion on a face by a side opposite to the through slot, and the protrusion is for being engaged with a restricting recess in a sleeve hole of a tool; the main body includes two said side boards and a plurality of the sleeved structures, the two side boards are arranged parallel to each other, and each of the side board has a part of the plurality of sleeved structures opposite to each other; the main body further includes a plurality of rib portions, the plurality of rib portions are laterally connected between the two side boards, and each said restricting member has a plurality of the receiving grooves; the main body further includes a spacing rib which is laterally connected to the plurality of rib portions, a distance between each said side board and the spacing rib is greater than a dimension of the restricting member along a referential direction, and the referential direction passes through the abutting portion and is parallel to a longitudinal direction of the abutting portion.

* * * * *